United States Patent [19]

Chen et al.

[11] Patent Number: 4,782,937

[45] Date of Patent: Nov. 8, 1988

[54] ESCROW DEVICE FOR COIN-OPERATED SYSTEMS

[75] Inventors: Abraham Y. Chen, Mountain View; Douglas D. Lau, Hillsborough, both of Calif.

[73] Assignee: Tatung Telecom Corp., Palo Alto, Calif.

[21] Appl. No.: 925,926

[22] Filed: Nov. 3, 1986

[51] Int. Cl.[4] ..... G07F 1/04

[52] U.S. Cl. ..... 194/346

[58] Field of Search ..... 194/346, 344, 347, 348, 194/349

[56] References Cited

U.S. PATENT DOCUMENTS 1,360,677 11/1920 Perry ..... 194/349 X
4,630,624 12/1986 Turner ..... 194/346

FOREIGN PATENT DOCUMENTS 242397 1/1963 Australia ..... 194/346

*Primary Examiner*—F. J. Bartuska
*Attorney, Agent, or Firm*—Burns, Doane, Swecker & Mathis

[57] ABSTRACT

A coin escrow device includes a housing for receiving coins, and first and second gates for selectively discharging coins to a coin return chute or to a coin collection chute. Actuating mechanisms are provided to selectively unlatch the gates and to bias the gates to their latched positions.

14 Claims, 2 Drawing Sheets

ESCROW DEVICE FOR COIN-OPERATED SYSTEMS

BACKGROUND OF THE INVENTION

1. Field of the Invention

The present invention generally relates to coin-operated sYstems and, more particularly to coin escrow devices for use in coin-operated sYstems such as vending machines, coin-operated telephones and the like.

2. State of the Art

Coin-operated vending systems such as coin-operated telephones often include devices, usually called "escrow" devices, to temporarily hold coins until such time as control signals indicate whether the coins should be returned to the system user or permanently collected. Typical escrow devices in coin-operated telephones, for example, include a mechanism to release coins to a coin box in the event that a call has been successfully placed and a mechanism to return coins to the calling party in the event that a call is not successfully connected to a called telephone station.

In practice, escrow devices for coin-operated vending systems must meet several requirements. Normally, the primary requirement is reliability: an escrow device must operate to discharge all escrowed coins to a collection box only when a vending operation has been successfully completed and, conversely, must return all escrowed coins to the system user only when a vending operation has not been satisfactorily completed. If an escrow device does not operate reliably, the vending system may be damaged by an irate user and revenue will be lost to the owner of the system. Also, in use with coin-operated telephones, coin escrow devices should operatewith the lowest possible energy consumption Still further in practice, coin escrow devices must be able to hold a large number of coins without causing erroneous discharge of the coins. For example, in the case of a typical coin-operated telephone, a coin escrow device should have sufficient capacity to hold a minimum of about twelve coins, and some escrow devices in coin-operated telephones hold about forty to sixty coins. (If all sixty coins were quarters, the escrowed value would be fifteen dollars).

Still further in practice, coin-operated systems must be resistant to jamming, whether the jamming action is intentionally or unintentionally caused. If a coin-operated system does not include features to preclude jamming by misoriented coins, for example, the system is likely in incur substantial down-time and require above average maintenance. Such conditions are costly for the owner of the system and cause dissatisfaction by users.

SUMMARY AND OBJECTS OF THE INVENTION

Generally speaking, the present invention provides a coin escrow device for use in coin-operated vending systems, including coin-operated telephones, which operates reliably and without jamming while requiring minimal energy for actuation.

In the preferred embodiment, a coin escrow device according to the present invention generally includes a housing for receiving coins; first and second gate members mounted within the housing to support coins in a latched position and to discharge coins in an unlatched position; a first actuator to selectively unlatch the first gate member and, following release, to provide a biasing force to return the first gate to the latched position; and second actuator to selectively unlatch the second gate and, thereafter, to return the second gate to the latched position. Further in the preferred embodiment, the first and second actuators are symmetrically arranged and each includes a solenoid having a core member that is selectively movable upward to unlatch the associated gate member. Also, a linking lever is pivotably connected between the core member and a common pivot on the housing, and a curved track is formed in the lever to receive a pin member rigidly fixed to the associated gate and positioned so that, after upward motion of the core member unlatches the gate, momentum of the gate member and weight of the coins thereon is converted to potential energy that later is used to return the gate toward the latched position.

Further in the preferred embodiment, the escrow device of the present invention includes structures to prevent coins from jamming within the device and to prevent entering coins from jarring the gate members sufficiently to cause inadvertent discharge of coins.

The foregoing and other objects and advantages of the present invention can be readily ascertained by reference to the following description and attached drawings which illustrate the preferred embodiment.

DETAILED DESCRIPTION OF THE PREFERRED EMBODIMENT

Figure 1:
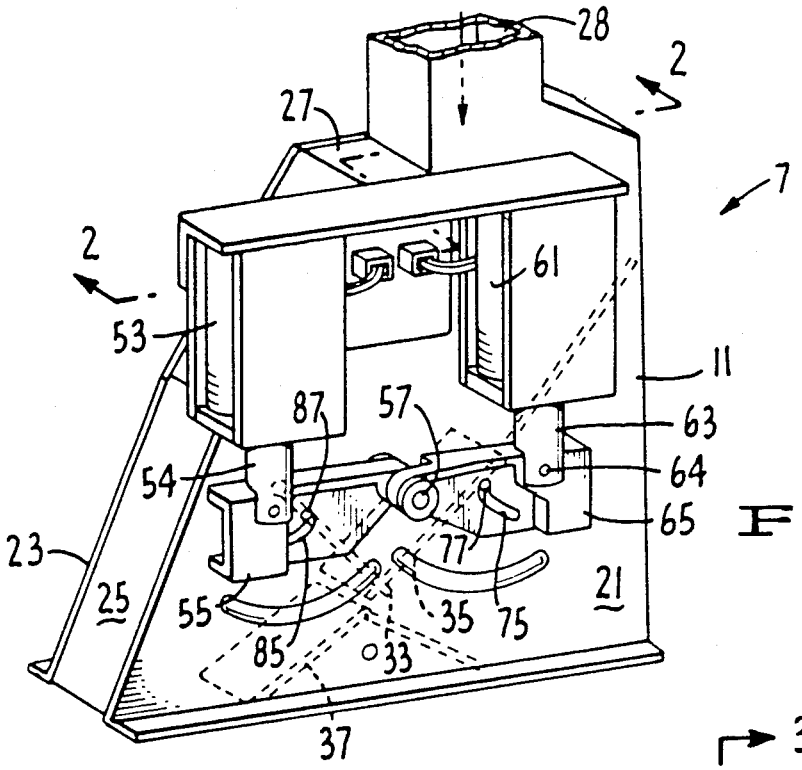
FIG. 1 is a pictorial view of a coin escrow device according to the present invention, with selected internal components shown by dashed lines.

Generally speaking, FIG. 1 shows a coin escrow device 7 to temporarily hold coins deposited in a coin-operated system such as a coin-operated telephone. Escrow device 7 includes a housing 11 whose general shape is determined by the size of the cabinet in which the device is mounted and by geometries of other components in the cabinet. For example, escrow device 7 normally would be accompanied in a telephone cabinet by mechanisms for accepting coins, for rejecting coins and for counting coins. In the illustrated embodiment, housing 11 has generally symmetrical front and back walls 21 and 23, side walls 25, a top wall 27 including a coin inlet chute 28 for receiving coins, and bottom coin outlets 29 and 31. In practice, sidewalls 25 are dimensioned so that front and back walls 21 and 23 are separated by a distance that equals about 1.5 times the diameter of a dime (U.S.); such spacing is ordinarily sufficient to prevent coins from lining up edge-to-edge such that the coins become jammed in a fixed position within housing 11. The outlets 29 and 31 direct coins, respectively, to a coin collection box and to a coin return mechanism. Although the size and shape of inlet 28 and outlets 29 and 31 is a matter of design choice, it is convenient for their widths also to be about one and one-half times the diameter of a dime (U.S.).

Figure 2:
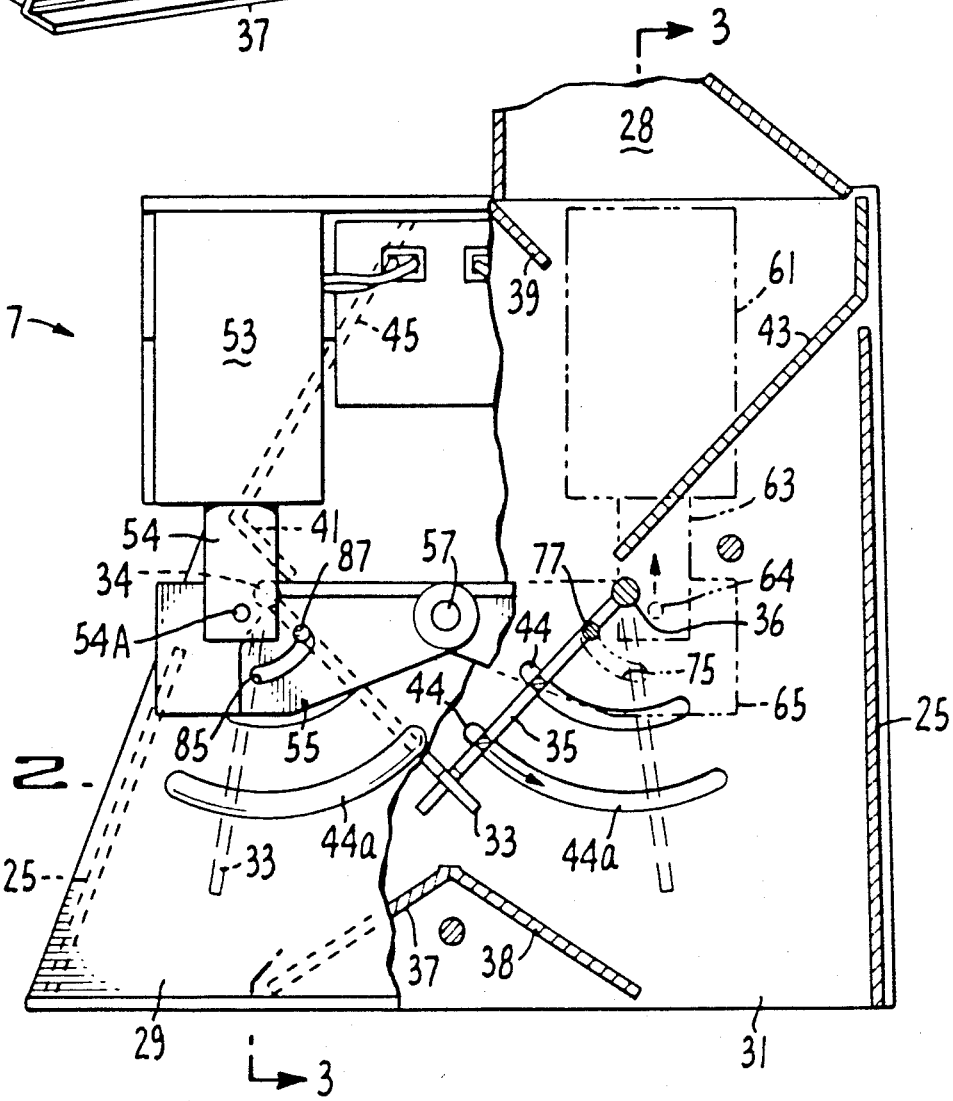
FIG. 2 is a side view of the device of FIG. 1 taken along the plane of line 2—2 for viewing in the direction of the arrows, with portions of the device cutaway and shown in cross-section.
Figure 3:
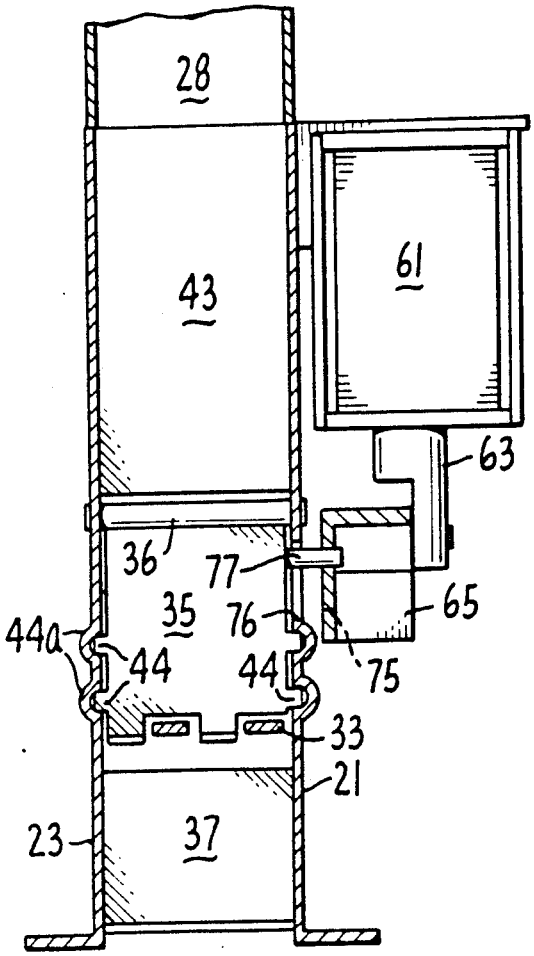
FIG. 3 is a cross-sectional view of the device of FIG. 2 taken along the plane of line 3—3 for viewing in the direction of the arrows.

Referring now to FIG. 2, the interior of housing 11 includes generally symmetrical gate members 33 and 35 to selectively control passage of coins to coin collection outlet 29 and coin return outlet 31. In the illustrated embodiment, gate member 33 is pivotably mounted about an axis 34 that extends horizontally between front and back walls 21 and 23 of housing 11 and, likewise, gate member 35 is pivotably mounted about an axis 36 that extends horizontally between the same two walls. Gate members 33 and 35 can each be described as having two positions: a latched position as shown by solid lines in FIG. 2, and an unlatched position shown by dashed lines. When gate members 33 and 35 are both unlatched, their lower ends abut. Preferably, as shown in FIG. 3, the lower ends of gate members 33 and 35 have matching slots and tabs that intermesh when both gate members are latched to prevent inadvertent discharge of coins between the abutting ends. Below gate members 33 and 35, a pair of stationary inclined wall members 37 and 38, respectively, guide coins to coin collection outlet 29 and coin return outlet 31.

To provide reliability in service, escrow device 7 includes means to prevent coins from becoming jammed in housing 11 and to prevent entering coins from jarring gate members 33 and 35 sufficiently to cause inadvertent discharge of coins. Accordingly, in the embodiment shown in FIG. 2, inlet chute 28 is offset horizontally from the vertical centerline of housing 11 and a stationary deflecting member 39 is mounted below the chute to deflect coins from falling directly onto gate members 33 and 35. Also, inclined deflecting members 41 and 43 are stationarily mounted to smoothly direct coins onto gate members 35 and 33, respectively. In practice, the deflecting members 39, 41, and 43 are mounted at an angle, usually about 60° from horizontal, to provide surfaces substantially steeper than the angle of repose of coins in housing 11.

As shown in FIG. 3, rib-like nub members 44 are formed on the sides of gate members 33 and 35 to extend into mating arcuate grooves 44A formed in sidewalls 21 and 23. The arcuate grooves 44A are shaped to allow gate members 33 and 35 to pivot freely without interference by sidewalls 21 and 23 of housing 11. As will be explained later herein in more detail, the purpose of nub members 44 and grooves 44A is to prevent coins from jamming gate members 33 and 35. As also best shown in FIG. 2, an inclined member 45 is mounted to block out a dead space in the housing on the side opposite offset inlet chute 28. In practice, inclined member 45 conserves space for other components of the vending system.

Escrow device 7 further includes symmetrical actuating mechanisms to selectively open and close gate members 33 and 35 with minimum energy while assuring that neither of the gate members inadvertently opens merely by reason of the weight of coins held in escrow. In the embodiment illustrated in FIG. 2, the actuating mechanism for gate member 33 includes a solenoid 53 that is stationarily mounted to sidewall 21 and that has a vertically movable core member 54. The lower end of core member 54 is pivotablY connected at point 54A to a linkage lever 55 whose opposite end is pivotably mounted to sidewall 21 by a horizontal pin 57 positioned generally midway between the pivot points 34 and 36 for respective gate members 33 and 35. Likewise, an actuating mechanism for gate member 35 includes a stationary solenoid 61 having a vertically movable core 63 that is pivotably connected at point 64 to a linkage lever 65 which is also pivotably connected to pin 57.

Figure 4:
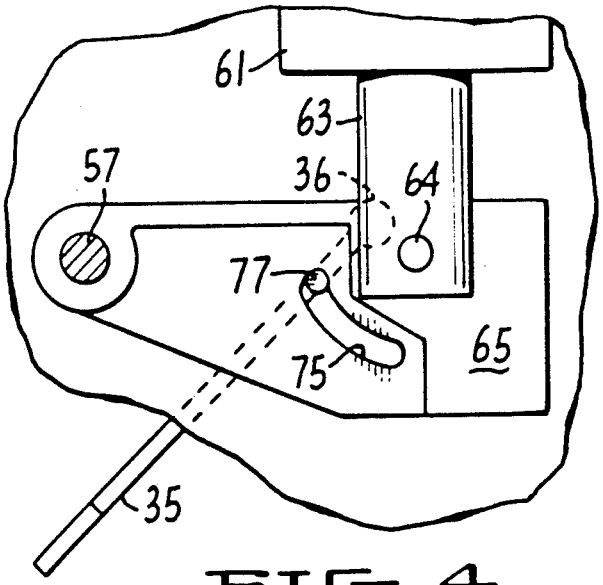
FIG. 4 is a detail view, drawn to an enlarged scale for purposes of explanation, of a mechanism included in the device of FIG. 1.
Figure 5:
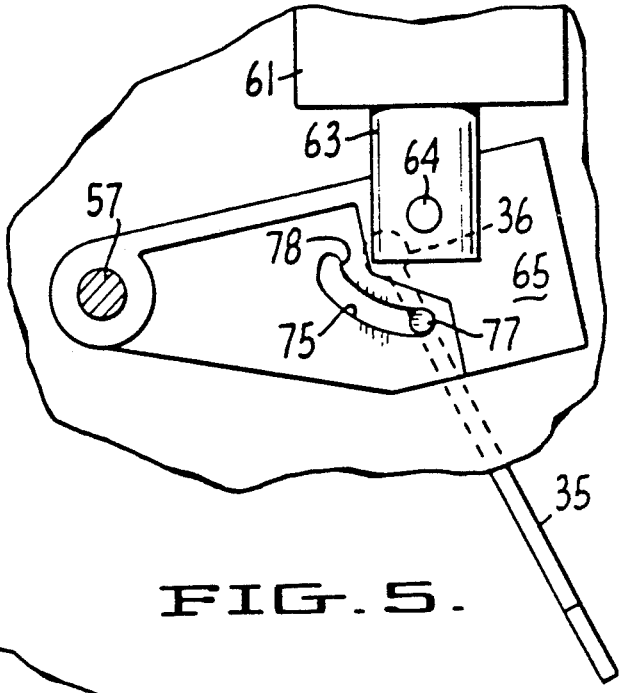
FIG. 5 is a detail view corresponding to FIG. 4 but with the mechanism in another position.
Figure 6:
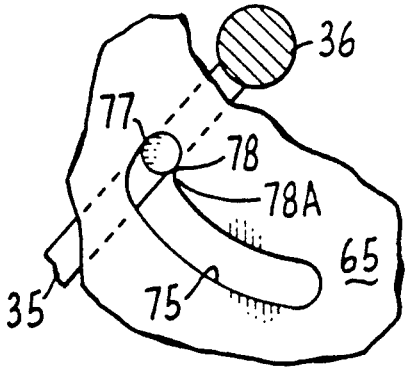
FIG. 6 is a detail view corresponding to FIG. 4 but drawn to a further enlarged scale.

As best shown in FIGS. 3-6, an arcuate slot or track 75 is formed through linkage lever 65 in front of an opening 76 (FIG. 3) formed through front wall 21 of housing 11. A pin member 77 extends through slot 75 and opening 76 for rigid connection to gate member 35 at a distance from pivot axis 36. As shown in FIGS. 4-6, the shape of slot 75 generally conforms to the arouate path that pin member 77 follows as gate member 35 is released from its latched position. Thus, the upward end of slot 75 corresponds with the fully latched position of gate member 35 and the downward end of slot 75 defines the limit of travel of gate member 35 in the unlatched position. Likewise, as shown in FIGS. 1 and 2, an arcuate slot 85 is formed through lever 55 and a pin member 87 is connected through the slot to gate member 33 at a distance from pivot axis 34. Slot 85 is also configured such that its upper end corresponds with the latched position of gate member 33 and its downward end defines the limit of travel of the gate member in the unlatched condition.

In practice, the widths of slots 75 and 85 exceed the diameters of pin members 77 and 87 sufficiently to allow the pin members to trace non-zero area paths, which may be referred to herein as "hysteresis" paths, during a complete travel cycle between the latched and unlatched positions of gate members 33 and 35 In other words, slots 75 and 85 are sufficiently wide that pin members 77 and 87 need not follow exactly the same paths through respective slots 75 and 85 when gate members 33 and 35 move from the unlatched positions to the latched positions as when the gate members move from the latched positions to the unlatched positions.

Referring now to FIG. 6, the upper end of slot 75 in lever member 65 includes a latch area defined by a linear sidewall section 78 whose length slightly exceeds the diameter of pin member 77. Linear sidewall section 78 is oriented towards being parallel to a tangent to the virtual direction of arcuate travel of lever 65 when gate member 35 is latched. This orientation minimizes resistance to unlatching gate member 35 because the force of pin member 77 against linear sidewall section 78 is approximately perpendicular to the arcuate direction of travel of lever 65. Also, linear sidewall section 78 is oriented toward being generally perpendicular to the virtual direction of travel of pin member 77 when gate member 35 is latched. Likewise, the upper end of slot 85 in lever member 55 includes a linear sidewall Sestion, not numbered, that is oriented toward being parallel to a tangent to the virtual direction of travel of lever 55 when gate member 33 is latched and, further, is oriented toward being perpendicular to the virtual direction of travel of pin member 87 when gate member 35 is latched.

The following is a description of the complete operation of coin escrow device 7. Initially it should be assumed that gate members 33 and 35 are latched, and that one or more coins have been introduced through inlet chute 28. As the coins enter housing 11, their kinetic energies are partially absorbed by striking deflecting walls 39 or 43. (In many conventional coin-operated telephones, quarters will enter on the left side of coin inlet chute 28, and dimes and nickels will enter on the right; thus, quarters will usually first strike deflecting wall 39 and other coins will first strike deflecting wall 43.) The coins then slide along inclined members 41 and 43 onto gate members 33 and 35 respectively, and collect at the vertex of the intersection of the two gate members. It should be appreciated that the structure intrior of housing 11 increases the orderliness with which coins are collected upon gate members 33 and 35 and, thereby, increases the capacity of escrow device 7 while minimizing opportunity for cins to jam. Also, the rib-like nus 44 on the sides of gate members 33 and 35 prevent coins from slipping into spaces between the sides of the gate members and sidewalls 21 and 23 of housing 11.

After coins have been collected in housing 11, the effective weight of gate members 33 and 35 and the effective weight of the accumulated coins cause pin member 77 to press perpendicularly against linear sidewall portion 78 of slot 75, and likewise, cause pin member 87 to press perpendicularly against the linear sidewall portion of slot 85. Gate members 33 and 35, however, remain latched regardless of the weight of the escrowed coins because the engaging forces between the pin members and the linear sidewall portions increase with the weight of the coins.

To unlatch gate member 35, solenoid coil 61 is energized to draw core member 63 upward as shown in FIG. 5. The upward motion of core member 63 causes lever 65 to pivot counterclockwise and, in turn, causes pin member 77 to move toward the lower edge 78A (FIG. 6) of linear sidewall portion 78. Because of the short distance to edge 78A of linear sidewall portion 78, only slight movement of solenoid core 63 is required to unlatch gate member 35; also, because linear sidewall portion 78 is oriented toward being generally parallel to the direction of counterclockwise motion of lever member 65 when gate member 35 is first unlatched, relatively little force is required to move pin member 77 toward the lower edge of linear portion 78. After pin member 77 passes lower edge 78A of linear portion 78, pin member 77 falls freely toward the lower end of arcuate slot 75 until gate member 35 is open sufficiently to permit discharge of coins to coin return outlet 31. It should be noted that once gate member 35 is unlatched, the weight of the escrowed coins pushes the gate member progressively open in a manner substantially independent of the energy applied to raise solenoid core 63 and, thereby, minimizes the energy required to open gate member 35. Further it should be noted that, as gate member travels away from its latched position, the kinetic energy of the gate member assists in raising solenoid core member 63 and lever member 65 and, thereby, increases their potential energies.

The motions involved in opening gate member 33 are analogous to those of opening gate member 35 and, therefore, will not be described in detail. Likewise, the motions and forces involved in closing gate member 33 are entirely analogous to those involved in closing gate member 35 and, therefore, need not be specifically described.

When either gate member 33 or 35 is unlatched while the other is latched, the latched gate member forms a ramp-like surface to direct coins past the unlatched gate member toward the appropriate discharge outlet. For example, when gate member 33 is unlatched, gate member 35 provides a slanting surface on which coins slide onto inclined wall member 37 and then into coin collection outlet 29. Likewise, when gate member 35 is unlatched, gate member 33 provides a surface that directs coins toward coin return outlet 31.

FIG. 5 shows pin member 77 at its lowest position in slot 75. In this position, more member 63 is at its maximum upward joint of travel, which is to say the potential energy of core member 63 is a relative maximum. Thus, when solenoid 61 is de-energized, core member 63 and lever member 65 move downward under the force of gravity, and the momentum of the two members provides torque in the clockwise direction of rotation to force pin member 77 to move upward within slot 75 toward the latched location shown in FIG. 6. Thus, it can be understood that the energy expended in raising solenoid cores 63 and 54 to open gate members 35 and 33, respectively, is substantially conserved in the form of potential energy and is utilized in closing the gate members.

As gate members 33 and 35 pivot from the fully unlatched position to the latched position, pin members 77 and 87 do not necessarily follow the same path relative to slots 75 and 85, respectively, as the pin members followed when the gate members moved from the latched position to the unlatched position. This feature, as previously mentioned, is a result of the widths of slots 75 and 85 exceeding the diameters of respective pin members 77 and 87. The fact that "play" exists in slots 75 and 85 reduces frictional effects and therefore allows the gate-opening energy to be more effectively converted to potential energy for subsequent use in moving the gate members toward the latched position.

For optical operation of escrow device 7, the components of the actuating mechanisms are balanced so that gate members 33 and 35 are biased toward their latched positions in the absence of forces due to energization of solenoids 53 or 61 or to weight of the coins on the gate members. On the other hand, the biasing forces should be sufficiently small that gate members 33 and 35 will not latch when any coins remaining in housing 11 exert force on the gate members. In practice, such balance is accomplished by only allowing the effective weight of solenoid core 63 plus the effective weight of lever member 65 to slightly exceed the effective weight of gate member 35 and, likewise, by only allowing the effective weight of solenoid core 54 plus the effective weight of lever member 55 to only slightly exceed the effective weight of gate member 33.

Figure 7:
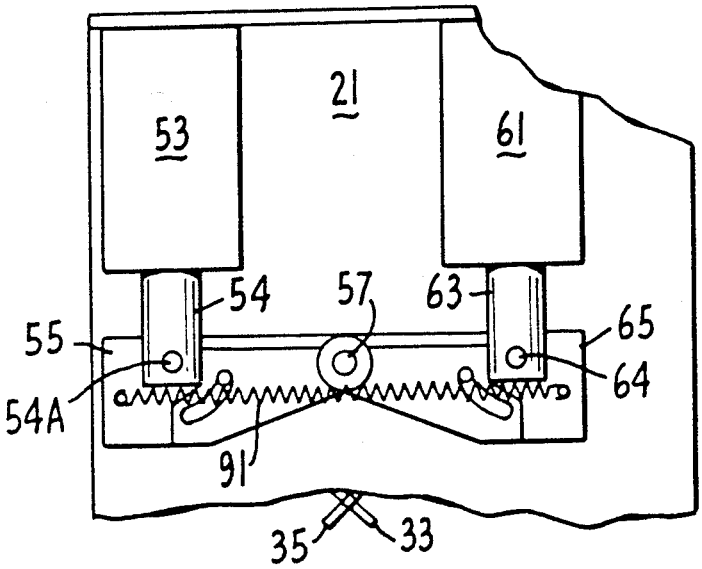
FIG. 7 is a side view of a portion of the device of FIG. 1 including optional elements.

Referring now to FIG. 7, an embodiment is disclosed wherein auxiliary spring force is utilized to assure latching of gate members 33 and 35. (Because the components of the escrow device of FIG. 7 are essentially the same as those previously described, the same reference numerals are provided.) In this embodiment, spring member 91 is connected between levers 55 and 65 with its ends separated by enough distance to provide substantially constant linear retractive force. Further, the ends of spring 91 are positioned on levers 55 and 65 such that, when either gate member 33 or 35 is fully open, the spring force is directed approximately through pivot point 57 and, as a result, the torque provided by spring 91 is nearly zero. Also, with spring 91 so positioned, spring force is applied to levers 55 and 65 at a significant radius away from their axis of rotation when gate members 33 and 35 are close to being latched; in other words, the torque applied by spring 91 increases as the gate members move toward the latching positions and becomes maximum as gate members 33 and 35 become fully latched. In practice, the spring constant of spring 91 is selected to be sufficiently small that, once either gate member 33 or 35 has been fully unlatched, the weight of a coin on the gate member will bias the gate open; in other words, the positioning and strength of spring 91 is such that a gate member, once opened, will not be forced closed so long as a coin is still held in escrow. Except for the influence of spring 91, operation of the embodiment of the escrow device in FIG. 7 is essentially the same as operation of the device of FIG. 1.

Although the present invention has been described with particular reference to the illustrated embodiments, such disclosure should not be interpreted as limiting. Various other alterations and modifications will not doubt become apparent to those skilled in the art after having read the preceding disclosure. In view of such variations, it is intended that the appended claims be interpreted as covering all alternative embodiments and equivalents as fall within the spirit and scope of the present invention.

What is claimed is:

1. A coin escrow device for use in vending systems that operate with minimal energy, comprising:

a housing;

a first gate means pivotably mounted within the housing to support coins in a latched position and to discharge coins to a coin return outlet in an unlatched position;

a second gate means pivotably mounted within the housing to support coins in a latched position and to discharge coins to a coin collection outlet in an unlatched position;

first actuating means connected to selectively unlatch the first gate means and, thereafter, to provide a biasing force that returns the first gate means to the latched position;

second actuating means connected to selectively unlatch the second gate means and, thereafter, to provide a biasing force that returns the second gate means to the latched position; and the first and second actuating means each including: a solenoid stationarily mounted to the housing, a core member movable vertically within the solenoid, a lever member pivotably connected between the core member and a common point on the housing, an arcuate track formed in said lever member, and a pin member fixed to the gate means and located to ride in the arcuate track such that the associated gate member is moved to an unlatched position by upward movement of the associated solenoid core and downward motion moves the gate means toward the latched position.

2. A coin escrow device as defined in claim 1 further including inclined members stationarily mounted within the housing to prevent entering coins from directly striking the first and second gate means.

3. A coin escrow device as defined in claim 2 including inclined members positioned in the housing to eliminate areas where coins can stationarily lodge when the first and second gate means are unlatched.

4. A coin escrow device as defined in claim 1 wherein said first and second actuating means are balanced such that the gate means is biased toward the latched position by a force which does not exceed the weight of a coin on the gate means.

5. A coin escrow device as defined in claim 1 wherein a latching area is defined by a generally linear portion of the sidewall of the arcuate track.

6. A coin escrow device as defined in claim 5 wherein said linear portion is aligned toward being substantially normal to the virtual direction of travel of the pin member when the associated gate means is latched.

7. A coin escrow device as defined in claim 6 wherein said linear portion is aligned toward being substantially parallel to a tangent to the direction of travel of the lever member.

8. A coin escrow device as defined in claim 1 wherein said core members, said lever members, and said gate means are balanced so that the gate means are biased toward the latched position by a force which does not exceed the weight of a coin on the associated gate means.

9. A coin escrow device as defined in claim 1 wherein said tracks are positioned so that upward motion of the associated core member unlatches the associated gate means and, thereafter, the weight of said solenoid core biases the gate means toward the latched position.

10. A coin escrow device as defined in claim 9 wherein each of said actuating means is balanced such that the associated gate means is biased toward the latched position by a force which does not exceed the force due to the weight of a coin on the gate means.

11. A coin escrow device for receiving and temporarily holding coins in coin-operated systems comprising:

(a) first and second gates symmetrically and pivotably mounted within a housing, the gates each having a latched position to support coins and an unlatched position to discharge coins;

(b) first and second actuator mechanisms connected to the first and second gates, respectively; each of said actuator means including a solenoid stationarily mounted to the housing, a core member substantially vertically movable within said solenoid, a linking lever pivotably connected between the core member and the housing, a pin member fixedly connected to the associated gate, and an arcuate slot formed in the linking lever to receive said pin member, said slot being located so that upward motion of the core member unlatches the gate to swing open freely and downward motion of said core member moves the gate toward the latched position with the effective weight of the core member plus the effective weight of said linking lever providing the forces biasing the gate toward said latched position.

12. A coin escrow device as defined in claim 11 wherein only the upper end of each arcuate slot is generally linear to define the latched position of each gate, said linear portion being substantially perpendicular to the direction of travel of a pin member when a gate is latched and substantially parallel to the direction of travel of the associated lever member.

13. A coin escrow device comprising:

a housing for receiving coins;

first and second symmetric gate means pivotably mounted within the housing, each having a latched position to support coins and an unlatched position to discharge coins;

first and second pin members fixed to the respective first and second gate means;

first and second solenoids having first and second substantially vertically-movable core members respectively;

first and second levers connected between the respective core members and a common pivot point on the housing spaced equally between the first and second gate means;

first and second arcuate slots formed in the first and second levers, respectively, to receive the respective first and second pin members and located so that upward motion of the core members unlatches the gate means and downward motion moves the gate means toward the latched position and having shapes that generally conform to the arcuate paths that the pin members follow as the gate members release from their latched positions; the core members, the lever members, and the gate means being balanced so that the gate means are biased toward the latched position by a force including the weight of the first and second core members which does not exceed the weight on the associated gate means of the lightest coin acceptable by the escrow device.

14. A coin escrow device comprising:

a housing for receiving coins;

first and second symmetric gate means pivotably mounted within the housing, each having a latched position to support coins and an unlatched position to discharge coins;

first and second pin members fixed to the respective first and second gate means;

first and second solenoids having first and second substantially vertically-movable core members respectively;

first and second levers connected between the respective core members and a common pivot on the housing spaced equally between the first and second gate means;

first and second arcuate slots formed in the first and second levers, respectively, to receive the respective first and second pin members and located so that upward motion of a solenoid core unlatches a gate means and downward motion moves the gate means toward the latched position;

the first and second slots each having a shape that generally conforms to the arcuate path that a pin member follows as the gate means release from their latched positions, and the first and second slots each being sufficiently wide that the pin members trace paths relative to the slots whose areas are non-zero during a travel cycle between the latched and unlatched positions of the gate members; and a tension spring connected between the first and second levers and located such that, as either the first or second gate means moves toward an unlatched position, the orientation of the spring force moves such that the spring force is directed approximately through the common pivot point and, thereby, provides a biasing torque that decreases as the respective gate means move toward their unlatched positions.

* * * * *